US005349981A

United States Patent [19]

Schmucki et al.

[11] Patent Number: 5,349,981

[45] Date of Patent: Sep. 27, 1994

[54] DRAIN VALVE FOR A FLUSH TANK

[75] Inventors: Peter Schmucki; Paul Wey, both of Eschenbach, Switzerland

[73] Assignee: Geberit AG, Jona, Switzerland

[21] Appl. No.: 124,961

[22] Filed: Sep. 21, 1993

[30] Foreign Application Priority Data

Sep. 21, 1992 [CH] Switzerland ..... 2951/92

[51] Int. Cl.[5] ..... F16K 31/22; F16K 33/00; E03D 1/35

[52] U.S. Cl. ..... 137/436; 4/378; 4/391; 4/415; 137/426; 137/433; 251/205

[58] Field of Search ..... 4/366, 378, 389, 390, 4/391, 415, 395; 137/410, 430, 433, 436, 441, 442, 443, 444, 426; 251/48, 205, 208

[56] References Cited

U.S. PATENT DOCUMENTS

| | | | |
|---|---|---|---|
| 2,010,119 | 8/1935 | Tilden | 4/391 |
| 2,077,832 | 4/1937 | Gebert | 4/391 |
| 3,516,094 | 6/1970 | Reagan | 137/436 |
| 3,969,774 | 7/1976 | Karlsson | 4/391 |
| 4,011,605 | 3/1977 | Karlsson et al. | 4/391 |
| 4,101,986 | 7/1978 | Wilgus et al. | 4/325 |
| 4,357,720 | 11/1982 | Stahli | 4/391 |
| 4,486,906 | 12/1984 | Meier | 4/391 |

FOREIGN PATENT DOCUMENTS

| | | | |
|---|---|---|---|
| 3400166 | 12/1984 | Fed. Rep. of Germany . | |
| 4113497 | 10/1992 | Fed. Rep. of Germany . | |
| 2662194 | 11/1991 | France . | |
| 2065737 | 7/1981 | United Kingdom | 4/391 |

*Primary Examiner*—George L. Walton
*Attorney, Agent, or Firm*—Bucknam and Archer

[57] ABSTRACT

The drain valve (1) has a valve tube (26) as well as an insert (37) with a float (38) in a valve housing (36). The float (38) is connected with the valve tube (26). In the bottom (49) of the insert (37) openings (39, 41*a*) are provided, which can be made to index by rotating a punched disk (40). For setting or resetting the flush water quantity, the punched disk (40) can be rotated by raising and turning the valve tube (26). Cogs (43) of the punched disk (40) will then engage in corresponding cutouts (45) at the lower end of the valve tube (26).

7 Claims, 2 Drawing Sheets

DRAIN VALVE FOR A FLUSH TANK

FIELD OF THE INVENTION

The invention relates to drain valves.

BACKGROUND OF THE INVENTION

DE-U-70 31 718 describes a valve which has in the valve housing a rotating punched disk, with which two different amounts of flush water can be set. To rotate the disk, an upper hood of the valve housing must be taken off. If the drain valve is already mounted in a flush tank, and in particular in the case of a concealed flush tank, this is not possible or hardly so.

From DE-A-34 00 166 a similar drain valve is known in which outside the valve housing a handle is arranged with which the desired flush water quantity is adjustable. Changing the quantity of flush water is indeed possible with this valve, but here too it is necessary to reach comparatively deep into the flush tank.

SUMMARY OF THE INVENTION

An object of the invention is to provide a drain valve of the above type with which setting or resetting the flush water quantity is much easier even with the drain mechanism already installed. Further, the drain valve should be inexpensive to manufacture and should operate reliably. The problem is solved by the invention according to claim 1.

In the new drain valve the flush water quantity is set by means of the valve tube. And since, as it is known, the valve tube protrudes from the top of the valve housing, it can be gripped easily and securely even with the drain mechanism installed, so that one needs to reach into the flush tank much less deeply than before. Nor is it necessary to remove any parts of the drain valve beforehand. According to a development of the invention, the valve tube has actuating means which can be brought into engagement with the valve tube to adjust the means for regulating the rate of fall of the valve tube. It has been found that setting or resetting is possible according to the invention for both valve types in the two patents cited above. For both, setting or resetting is possible by raising and turning the valve tube. In one case the actuating means are arranged at the lower end of the valve tube, in the other case above the float. Thus the manipulations are the same for both valve types. Other advantageous features will become evident from the dependent claims, the description that follows, and the drawings.

BRIEF DESCRIPTION OF THE DRAWINGS

Two embodiment examples of the invention will be explained more specifically below with reference to the drawing, in which:

FIG. 1 shows a drain valve 1 with a valve tube 26, which is here at the same time an overflow tube. Tube 26 is mounted in a valve housing 36 for limited vertical raising. To this end, at the upper end of the valve tube 26 an eye 25 is provided, into which a lever 24 of an actuating device engages. Valve tube 26 is raised by pivoting the lever 24. At the lower end of valve tube 26 there is fastened in a holder 44 a valve disk 27 which cooperates with a valve seat 28. When the valve tube 26 is being raised, valve disk 27 is lifted off the valve seat. Flush water contained in the flush tank 3 can be discharged through lateral windows 50 of valve housing 36 into a drain opening 48 of a pipe 29 and finally into a toilet bowl not shown here. The drain valve 1 can be fastened to the flush tank 3 by means of a nut 31 in the usual manner. Nut 31 is screwed onto a male thread 32 of pipe 29. A seal ring 30 ensures a liquid proof connection.

Figure 1:
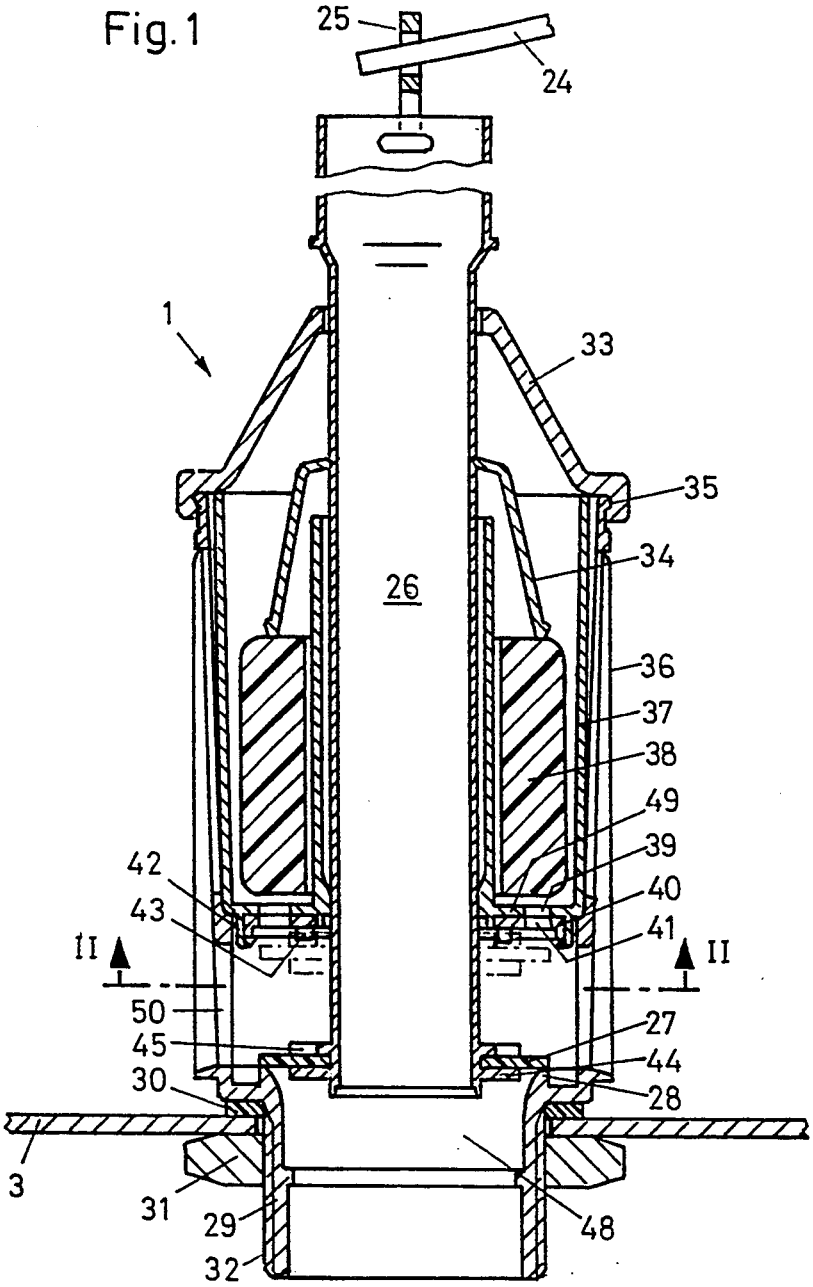
FIG. 1 is a longitudinal section through a drain valve according to the invention.

Now in order to make sure that the valve tube 26 will not close the valve immediately after flushing, there is arranged in an insert 37 an annular float 38 which is connected to the valve tube 26 via a hoodlike stop 34. Insert 37 is connected with the valve housing 36 by means of a covering hood 33. Hood 33 in turn is attached to the valve housing 36 by a snap connection 35. With the flush tank 3 filled, insert 37 is filled with flush water. Float 38 exerts on valve tube 26 an upwardly directed force, which however is much smaller than the pressure of the flush water onto the valve disk 27. With the valve tube 26 raised, on the other hand, float 38 can, when insert 37 is filled, hold the valve tube 26 in the raised position. In order to let the flush water contained in insert 37 during flushing, issue from the insert, two outlet openings 39 are provided in the bottom 49 of insert 37. These openings 39 are of comparatively large dimensions, so that the level of the water in the insert 37 will essentially drop with the level of the rest of the flush water during a flushing operation. Thus the insert 37 is essentially evacuated when the flush water outside insert 37 has reached the level of the bottom 49. At the latest at that moment the lift of float 38 no longer exists and the valve tube 26 falls down onto the valve seat 28. In this case the drain valve is closed before the flushing tank 3 is completely emptied.

Figure 2:
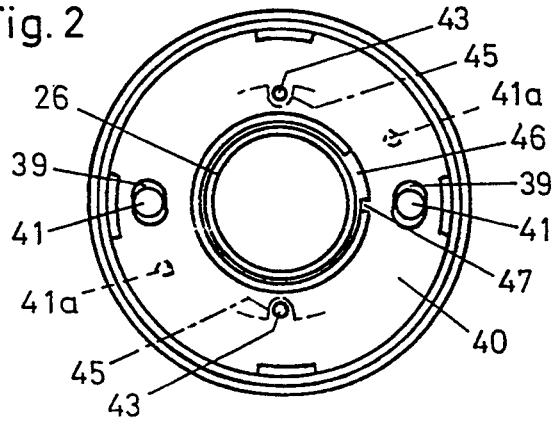
FIG. 2 a section along line II—II of FIG. 1.

Now in order to provide with the same drain valve 1 flushing with complete evacuation of the tank, there is arranged on the underside of bottom 49 a punched disk 40 which has two outlet openings 41 and two smaller outlet openings **41*a*, which can be made to coincide with the openings 39. By rotating the punched disk 40, the openings 39 can be covered up. If the smaller openings 41*a* coincide with the outlet openings 39, the result is that insert 37 will be evacuated through the openings 41*a* more slowly upon flushing. Float 38, therefore, exerts a lift on the valve tube 26 during a flushing operation for a longer time. Now the exit speed of the flush water from insert 37 can be rated by giving to the openings 41*a* the respective dimensions, in such a way that the valve tube falls back onto the valve seat 28 only after the flush tank is completely evacuated. In FIGS. 1 and 2 the punched disk 40 is shown in a position in which the passage openings 39** are not covered up. In this position, therefore, only a partial flushing, for example with six liters of flush water, can be triggered.

To reset the drain valve 1, two cutouts 45 are arranged in the holder 44 on the top in such a way that with the valve tube 26 raised they can be brought into engagement with two downwardly projecting cogs 43. These cogs are integrally formed on the bottom side of the punched disk 40. As has been mentioned hereinabove, the punched disk 40 is rotatably mounted on the bottom side of insert 37. The rotation is limited by a cog 47 integrally formed on disk 40, the cog engaging in a slot 46. Four pawls 42 integrally formed on the bottom 49 hold and guide the disk 40. FIG. 1 shows in broken lines the lower part of tube 26 in the position in which the cogs 43 engage in the cutouts 45.

To reset valve 1, the valve tube 26 is gripped at the upper end and raised until the cogs 43 engage in the respective cutouts 45. Then valve tube 26 is turned about its longitudinal axis until the punched disk 40 strikes against the other projection. The passage openings 39 are now covered up by disk 40. Upon flushing, the water contained in insert 37 escapes from it comparatively slowly through the openings and the float exerts a lift on valve tube 26 for a longer time than in the other position. With this adjustment, valve tube 26 closes the valve only after the flush tank is completely emptied.

Figure 3:
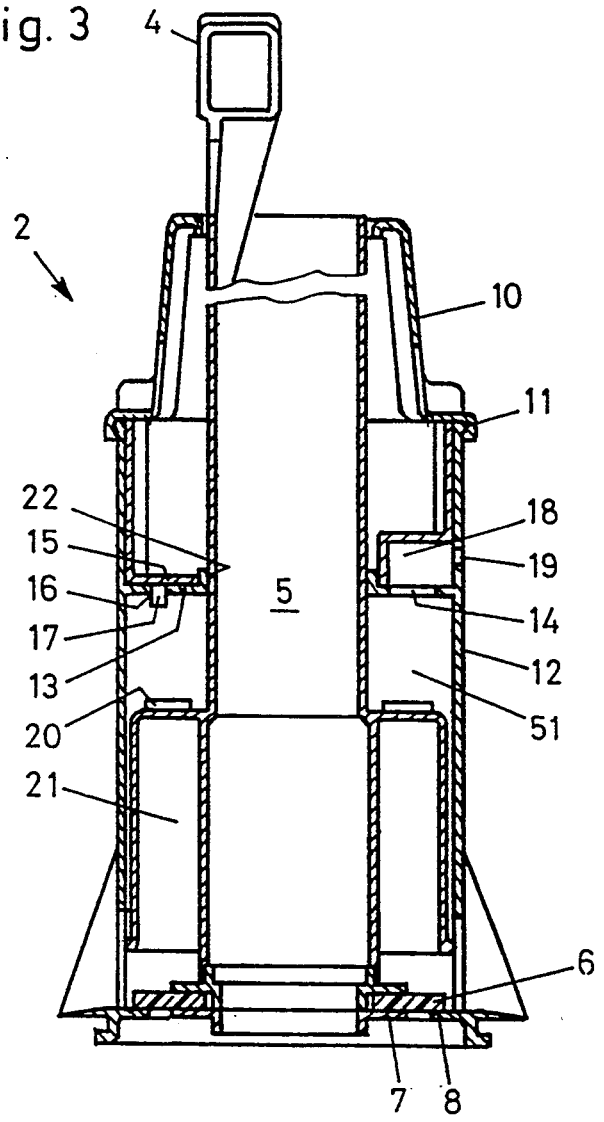
FIG. 3 a longitudinal section through a further embodiment of a drain valve according to the invention.
Figure 4:
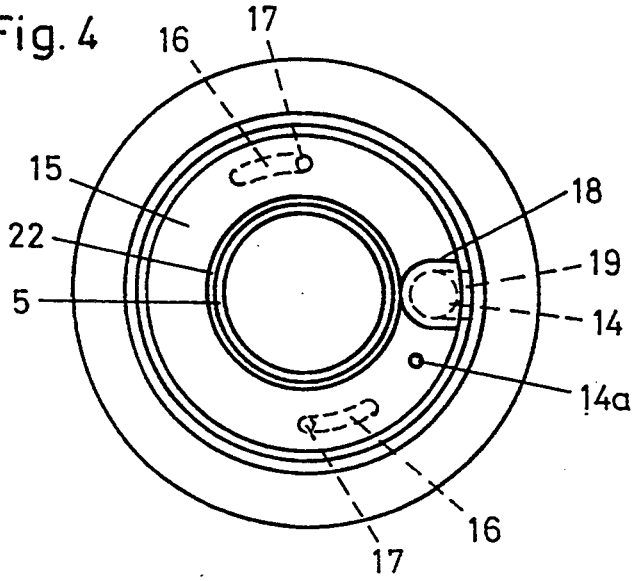
FIG. 4 a top view onto the drain valve according to FIG. 3, some parts being omitted for greater clarity.

In the form of the drain valve 2 shown in FIGS. 3 and 4, for resetting or adjusting the flush water quantity a valve tube 5 is raised in exactly the same way and is subsequently turned by a certain angle about the longitudinal axis of tube 5. As the float, however, there is provided here a chamber 21 open at the bottom which is integrally formed at valve tube 5 and which has projections 20 on the top. At the lower end of the valve tube, a valve disk 6 is applied at a holder 7 in the usual maner, and at the upper end the valve tube 5 has an eye 4 into which engages a lever of an actuating system not shown here. To trigger the flushing, tube 5 is raised. The tube is mounted in a valve housing 12, in the interior of which an intermediate bottom 13 is formed which has a central opening 22 for receiving the valve tube 5 as well as two smaller axially offset kidney-shaped openings 16, into each of which a cog 17 engages. These cogs 17 are formed on the bottom side of a disk 15 which is inserted from above into the housing 12 and is rotatably mounted therein. The openings 16 limit the rotation of disk 15. In the position of valve tube 5 shown in FIGS. 3 and 4, a lower cavity 51 of valve housing 12 is connected with the surrounding of valve 2 via an opening 14, a channel 18 of disk 15, and an opening 19 in housing 12. During flushing this arrangement has the following effect. To trigger the flushing, valve tube 5 is raised as usual until the air-filled chamber 21 abuts on the intermediate bottom 13. The lift of chamber 21 in the flush water holds the valve tube 5 temporarily in lifted position. However when the flush water in the tank sinks below the level of the intermediate bottom 13, air passes from the exterior of the valve housing through the openings 19 and 14 into the cavity 51, which is promptly filled with air as the flush water level sinks. The lift in chamber 21 decreases more and more, until finally the valve tube 5 falls back onto the valve seat 8. In this case valve 2 is closed before the flush tank is completely emptied.

If the flush tank is to be emptied completely, disk 15 is rotated to a limited extent by raising and turning the valve tube 5. In the end position now reached, the opening 14 indexes with a smaller opening 14*a* of disk 15 and the opening 19 is covered up. Now if flushing has been triggered by raising valve tube 5, no air can enter into the interstice 51 even when the level of the flush water has dropped to below that of the intermediate bottom 13. Thus, chamber 21 continues to be given a lift and keeps the valve open while through the openings 14 and 14*a* water flows slowly out of the upper chamber of housing 12. But as soon as the upper chamber is empty and no water flows up, air gets through openings 14 and 14*a* into the interstice 51 and the water contained therein exits downwardly. The lift of chamber 21 is thereby eliminated and the flush tube 5 falls back onto the valve seat 8 and closes the valve. Here closing occurs essentially when the flush tank is completely emptied.

To reset valve 2, the valve tube 5 is raised, as has been mentioned. The cogs 17 are then brought into engagement with the projections 20. During rotation of the valve tube 5, the projections 20 catch the cogs 17 until the latter have reached the other end of an opening 16.

For both valves 1 and 2, therefore, the process of resetting or adjusting the flush water quantity is exactly the same, although, as can be seen, the internal construction of the valves is quite different. Thus, different drain valves can, according to the invention, be set or reset with identical manipulations. Since in each instance the valve tube 5 or 26 is gripped at its upper end, it is sufficient to reach less deeply into the flush tank than previously when the drain valve is installed. This is especially important for concealed flush tanks where access to the interior is more difficult.

We claim:

1. In a drain valve for a flush tank having a valve housing (12,36) mounted in said flush tank, a valve tube (5,26) axially movably mounted in said valve housing with a closing element (6,27) disposed at the lower end thereof for closing the drain opening in said flush tank, a float (21,38) cooperating with said valve tube, and means (15,40) for regulating the sinking speed of said valve tube, the improvement comprising:

said valve tube (5,26) including engagement means (20,45) engagable with said means (15,40) for regulating the sinking speed of said valve tube by the displacement of said valve tube whereby the means (15,40) for regulating the sinking speed of the valve tube can be adjusted when the closing element is in an open position and a portion of said valve tube being in an operative locking engagement with said regulating means as said float reaches a predetermined position in response to a predetermined water level in said flush tank.

2. The drain valve as defined in claim 1, wherein said means (15,40) for regulating the sinking speed of said valve tube is adjustable by raising said valve tube so as to engage said engagement means (20,45) thereof with said regulating means (15,40) and axially rotating said valve tube.

3. The drain valve as defined in claim 2, wherein said regulating means includes a disk (15,40) rotatably mounted on said valve housing (12,36) and engagable with said engagement means (20,45) when said valve tube is raised.

4. The drain valve as defined in claim 3, wherein said engagement means (45) is arranged at the bottom end of said valve tube (26) and said disk (40) includes various sized openings therein and is arranged at the lower end of a float vessel (37), said disk (40) being selectively rotated by said engagement means (45) to vary the size of the openings therein upon the selective rotation of said valve tube (26) for regulating the sinking speed of said valve tube as said closing element (27) moves towards the drain opening in said flush tank.

5. The drain valve as defined in claim 3, wherein said valve tube (5) has a float chamber (21) formed thereon and said engagement means (20) are arranged at an upper end of said chamber (21).

6. The drain valve as defined in claim 5, wherein said means (15) for regulating the sinking speed of said valve tube includes a punched disk (15) having various sized openings therein rotatably mounted between a covering hood (10) of said valve housing (12) and an intermediate bottom wall (13) of said valve housing which defines a chamber therein.

7. The drain valve as defined in claim 6, wherein said punched disk (15) has cogs (17) protruding through kidney-shaped openings (15) in intermediate wall (13) which are engageable with engagement means (20) upon lifting of said valve tube (5), whereby selective rotation of said valve tube permits selective rotation of said disk to vary the size of the openings for regulating the sinking speed of the valve tube as the closing element (6) is moved towards the drain opening in said flush tank.

* * * * *